US011643858B2

(12) United States Patent
Rossi et al.

(10) Patent No.: US 11,643,858 B2
(45) Date of Patent: May 9, 2023

(54) PLASTIC DOOR CHECK WITHOUT STEEL FASTENERS

(71) Applicant: VENTRA GROUP, CO., Halifax (CA)

(72) Inventors: Tim G. Rossi, Bolton (CA); W. Murray Dobson, Nobleton (CA)

(73) Assignee: Ventra Group Co., Halifax (CA)

( * ) Notice: Subject to any disclaimer, the term of this patent is extended or adjusted under 35 U.S.C. 154(b) by 406 days.

(21) Appl. No.: 17/077,382

(22) Filed: Oct. 22, 2020

(65) Prior Publication Data

US 2021/0131141 A1 May 6, 2021

Related U.S. Application Data

(60) Provisional application No. 62/930,041, filed on Nov. 4, 2019.

(51) Int. Cl.

| | |
|---|---|
| ***E05C 17/20*** | (2006.01) |
| ***E05C 17/24*** | (2006.01) |
| ***E05F 5/02*** | (2006.01) |

(52) U.S. Cl.

CPC ..... *E05C 17/203* (2013.01); *E05C 17/24* (2013.01); *E05F 5/025* (2013.01); *E05Y 2900/531* (2013.01)

(58) Field of Classification Search

CPC ..... E05C 17/203; E05C 17/206; E05C 17/20; E05C 17/22; E05C 17/24; E05C 17/26; E05C 17/28; E05C 17/163

See application file for complete search history.

(56) References Cited

U.S. PATENT DOCUMENTS

| | | | | |
|---|---|---|---|---|
| 6,370,733 | B2 * | 4/2002 | Paton | E05C 17/203 292/262 |
| 6,687,953 | B1 | 2/2004 | Liang | |
| 6,842,943 | B2 * | 1/2005 | Hoffmann | E05C 17/203 16/50 |
| 6,901,630 | B2 * | 6/2005 | Liang | E05C 17/203 16/86 B |

(Continued)

FOREIGN PATENT DOCUMENTS

| | | |
|---|---|---|
| GB | 2358673 B | 3/2003 |
| WO | 00/49257 | 8/2000 |
| WO | 2017/078737 A1 | 5/2017 |

*Primary Examiner* — Jeffrey O'Brien

(74) *Attorney, Agent, or Firm* — Pillsbury Winthrop Shaw Pittman, LLP

(57) ABSTRACT

A door check device for installation between a vehicle body and a vehicle door that swings in opposing opening and closing directions relative to the vehicle body is provided. The door check device comprises a housing assembly and an elongated link member. The housing assembly comprises a first mounting structure, and a plastic housing member containing a biasing structure, a first link member engaging structure and a second link member engaging structure therein. The plastic housing member has a first engagement structure. The first mounting structure includes a plastic cover that has a second engagement structure that is constructed and arranged to engage with the first engagement structure to form an area of contact therebetween. The plastic housing member and the plastic cover are secured by fusion of the materials to each other in the area of contact between the first and the second engagement structures.

4 Claims, 14 Drawing Sheets

(56) References Cited

U.S. PATENT DOCUMENTS

| | | | | |
|---|---|---|---|---|
| 6,901,634 | B2 * | 6/2005 | Shaw | E05C 17/203 403/364 |
| 10,260,260 | B2 * | 4/2019 | Youn | E05C 17/203 |
| 10,329,810 | B2 * | 6/2019 | Kamata | E05C 17/203 |
| 10,626,641 | B2 * | 4/2020 | Ueno | E05F 5/06 |
| 2003/0159243 | A1 * | 8/2003 | Audisio | E05C 17/203 16/82 |
| 2006/0207058 | A1 * | 9/2006 | Heinrichs | E05C 17/203 16/86 B |
| 2006/0267353 | A1 * | 11/2006 | Van Den Heuvel | E05C 17/203 292/262 |
| 2006/0267354 | A1 * | 11/2006 | Petrus Van Den Heuvel | E05C 17/203 292/262 |
| 2019/0010741 | A1 * | 1/2019 | Youn | E05C 17/206 |
| 2021/0164276 | A1 * | 6/2021 | Hoffmann | E05C 17/163 |

* cited by examiner

SECTION A-A

SECTION B-B

SECTION D-D

Detail C
Scale: 3:1

Section cut D-D
Scale: 1:1

SECTION VIEW B-B

Detail C
Scale: 3:1

PLASTIC DOOR CHECK WITHOUT STEEL FASTENERS

CROSS-REFERENCE TO RELATED APPLICATIONS

This application claims priority to U.S. Provisional Patent Application No. 62/930,041, filed Nov. 4, 2019, the subject matter of which is incorporated herein by reference in entirety.

BACKGROUND

Field

The present patent application relates to a door check device for installation between a motor vehicle body and a motor vehicle door that swings in opposing opening and closing directions relative to the motor vehicle body.

Description of Related Art

Door check devices are well-known in the art for use in checking the swinging motion of automotive/motor vehicle doors. These door check devices generally comprise a link member with one or more sets of detents and a housing that contains a pair of spring-biased rolling elements. The link member is inserted through the housing so that the rolling elements are engaged in rolling contact with the surfaces thereof under their respective spring biasing. Either the link member or the housing is secured to the motor vehicle door panel and the other of the link member and the housing is secured to the motor vehicle body. As the vehicle door panel is swung open, the link member moves relative to the housing. When the rolling elements are received within a set of detents on the link member, the detents and rolling elements cooperate to maintain the link member and housing against relative movement until a force sufficient to overcome the biasing on the rolling elements and disengage the rolling elements from the detents is applied to the vehicle door panel. As a result, the door check device functions to yieldingly maintain the vehicle door panel in position based on the cooperation between the rolling elements and the detents.

Current plastic door check devices use steel fasteners, such as rivets/pins/screws to secure the two halves of the housing of the door check device together. These steel fasteners require corrosion plating and add additional weight to the door check device. Further, the processing time to install these steel fasteners can increase cost of the door check device.

Consequently, it would be advantageous to provide an improved door check device that obviates the shortcomings associated with the prior art door check devices discussed above.

Brief Summary

In one embodiment of the present patent application, a door check device is provided for installation between a vehicle body and a vehicle door that swings in opposing opening and closing directions relative to the vehicle body. The door check device comprises a housing assembly and an elongated link member. The housing assembly comprises a first mounting structure constructed and arranged to be mounted on one of the vehicle body and the vehicle door; a biasing structure; a first link member engaging structure and a second link member engaging structure; and a plastic housing member containing the biasing structure, the first link member engaging structure and the second link member engaging structure therein. The plastic housing member has a first engagement structure. The first mounting structure has a plastic cover. The plastic cover has a second engagement structure that is constructed and arranged to engage with the first engagement structure to form an area of contact therebetween. The plastic housing member and the plastic cover are secured by fusion of the materials to each other in the area of contact between the first and the second engagement structures.

The elongated link member extends through the housing assembly. The elongated link member comprises a second mounting structure constructed and arranged to be mounted on the other of the vehicle body and the vehicle door; and detents that extend generally in a transverse direction of the elongated link member on opposing face surfaces thereof. When the door check device is installed and the vehicle door is swung in the opposing opening and closing directions thereof relative to the vehicle body, the elongated link member and the housing assembly are configured to move relative to each other with the first and the second link member engaging structures travelling along the opposing face surfaces of the elongated link member.

When the door check device is installed and the vehicle door is swung in the opposing opening and closing directions thereof relative to the vehicle body, the biasing structure is configured to bias the first and the second link member engaging structures relatively towards one another to thereby urge the first and the second link member engaging structures into engagement with the opposing face surfaces of the elongated link member. When the door check device is installed and the vehicle door is swung to a location with respect to the vehicle body, the first and the second link member engaging structures cooperate with the detents on the opposing face surfaces of the elongated link member so as to maintain the vehicle door at that position until a force is applied to the vehicle door that is sufficient to cause the elongated link member and the housing assembly to move relative to each other so as to urge the first and the second link member engaging structures relatively apart from one another and out of cooperation the detents on the opposing face surfaces of the elongated link member against the biasing of the biasing structure.

These and other aspects of the present patent application, as well as the methods of operation and functions of the related elements of structure and the combination of parts and economies of manufacture, will become more apparent upon consideration of the following description with reference to the accompanying drawings, all of which form a part of this specification, wherein like reference numerals designate corresponding parts in the various figures. In one embodiment of the present patent application, the structural components illustrated herein are drawn to scale. It is to be expressly understood, however, that the drawings are for the purpose of illustration and description only and are not intended as a definition of the limits of the present patent application. It shall also be appreciated that the features of one embodiment disclosed herein can be used in other embodiments disclosed herein. As used in the specification and in the claims, the singular form of "a", "an", and "the" include plural referents unless the context clearly dictates otherwise. In addition, as used in the specification and the claims, the term "or" means "and/or" unless the context clearly dictates otherwise. It should also be appreciated that some of the components and features discussed herein may be discussed in connection with only one (singular) of such components, and that additional like components which may be disclosed herein may not be discussed in detail for the sake of reducing redundancy.

Other aspects, features, and advantages of the present patent application will become apparent from the following detailed description, the accompanying drawings, and the appended claims.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION OF THE DRAWINGS

Figure 1:
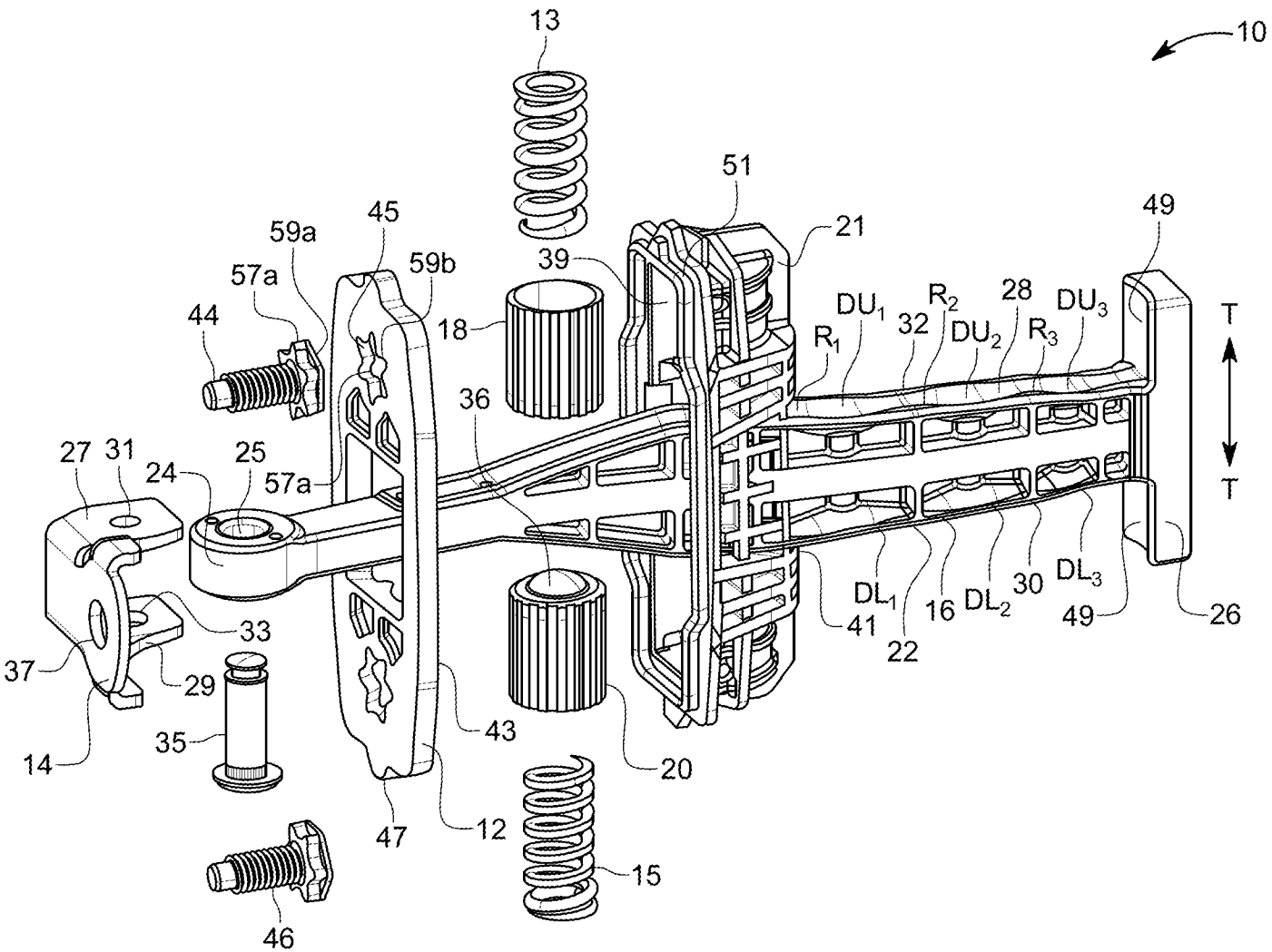
FIG. 1 shows an exploded view of a door check device in accordance with an embodiment of the present patent application.
Figure 2:
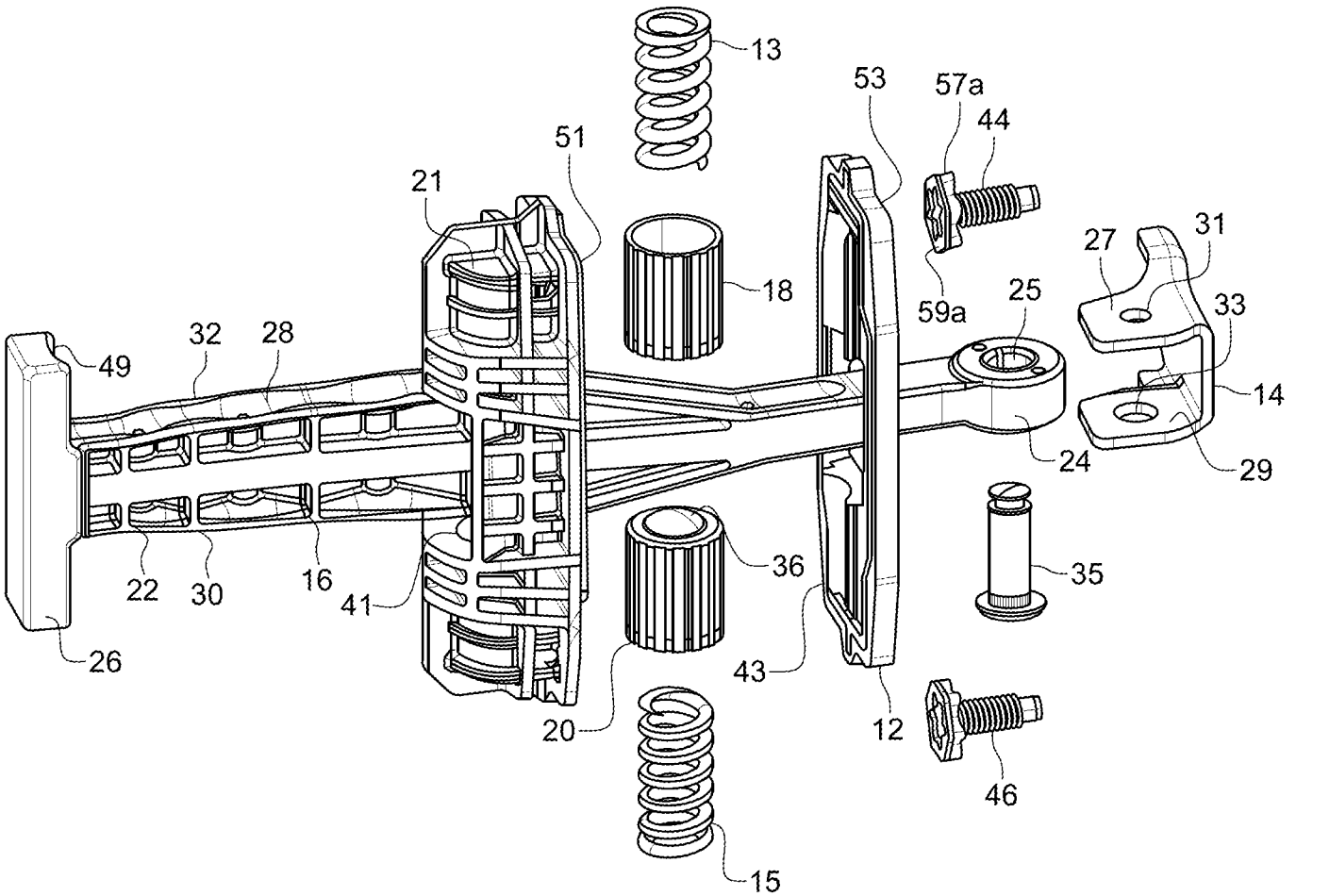
FIG. 2 shows another exploded view of the door check device in accordance with an embodiment of the present patent application.
Figure 3:
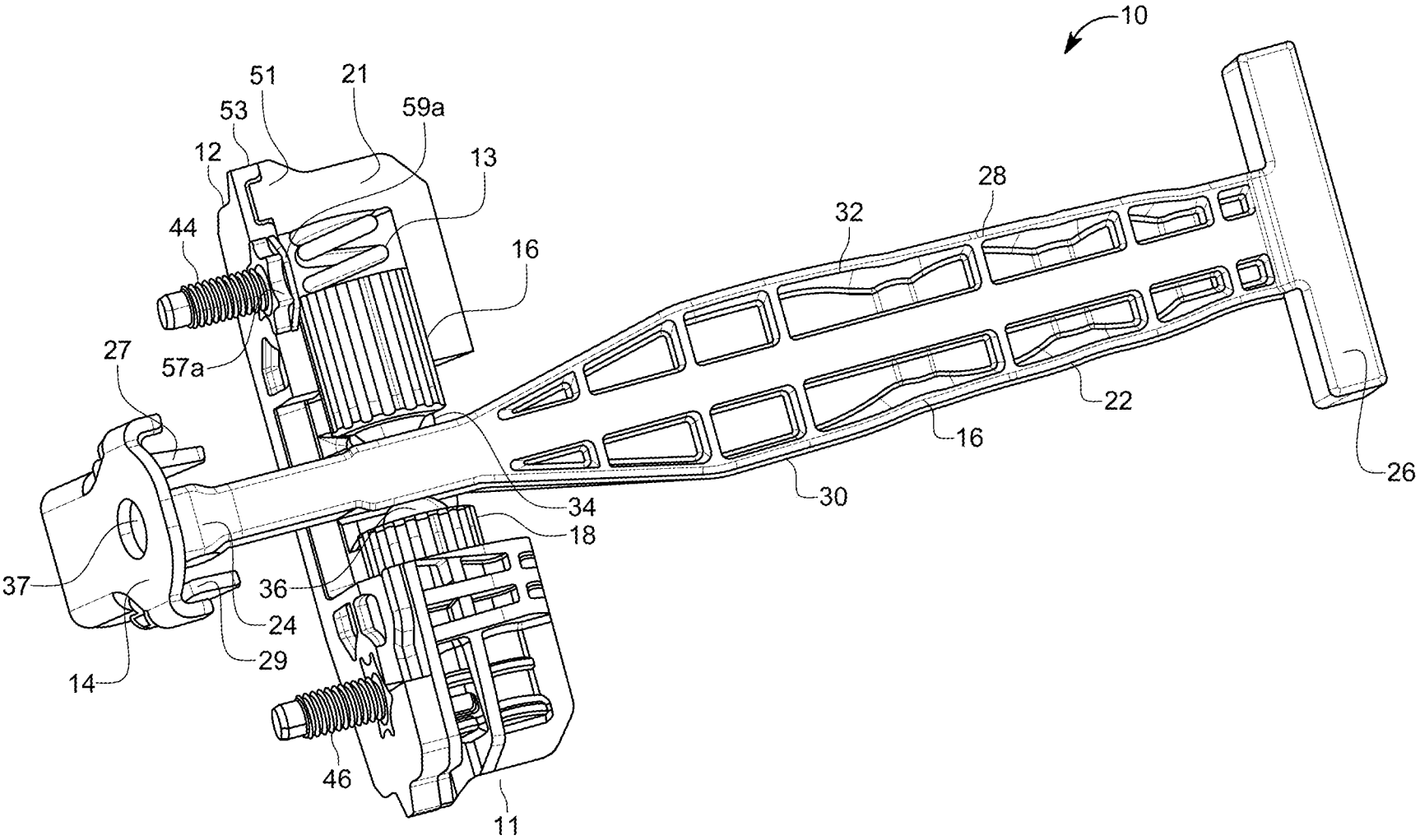
FIG. 3 shows a perspective, assembled view of the door check device, with a portion of the housing removed for clarity purposes, in accordance with an embodiment of the present patent application.
Figure 4:
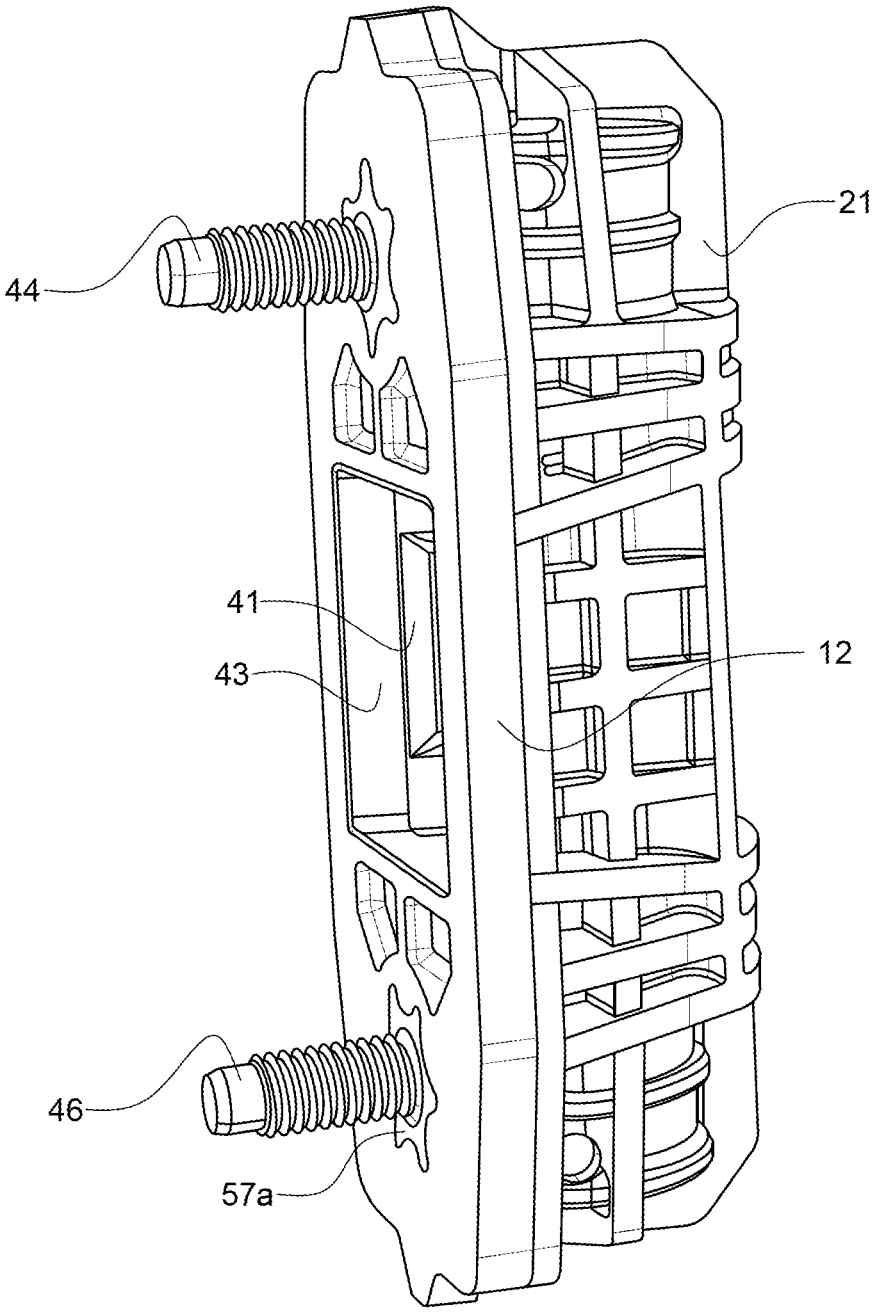
FIG. 4 shows a perspective view of a plastic housing member and a plastic cover of the door check device secured to each other in accordance with an embodiment of the present patent application.
Figure 5:
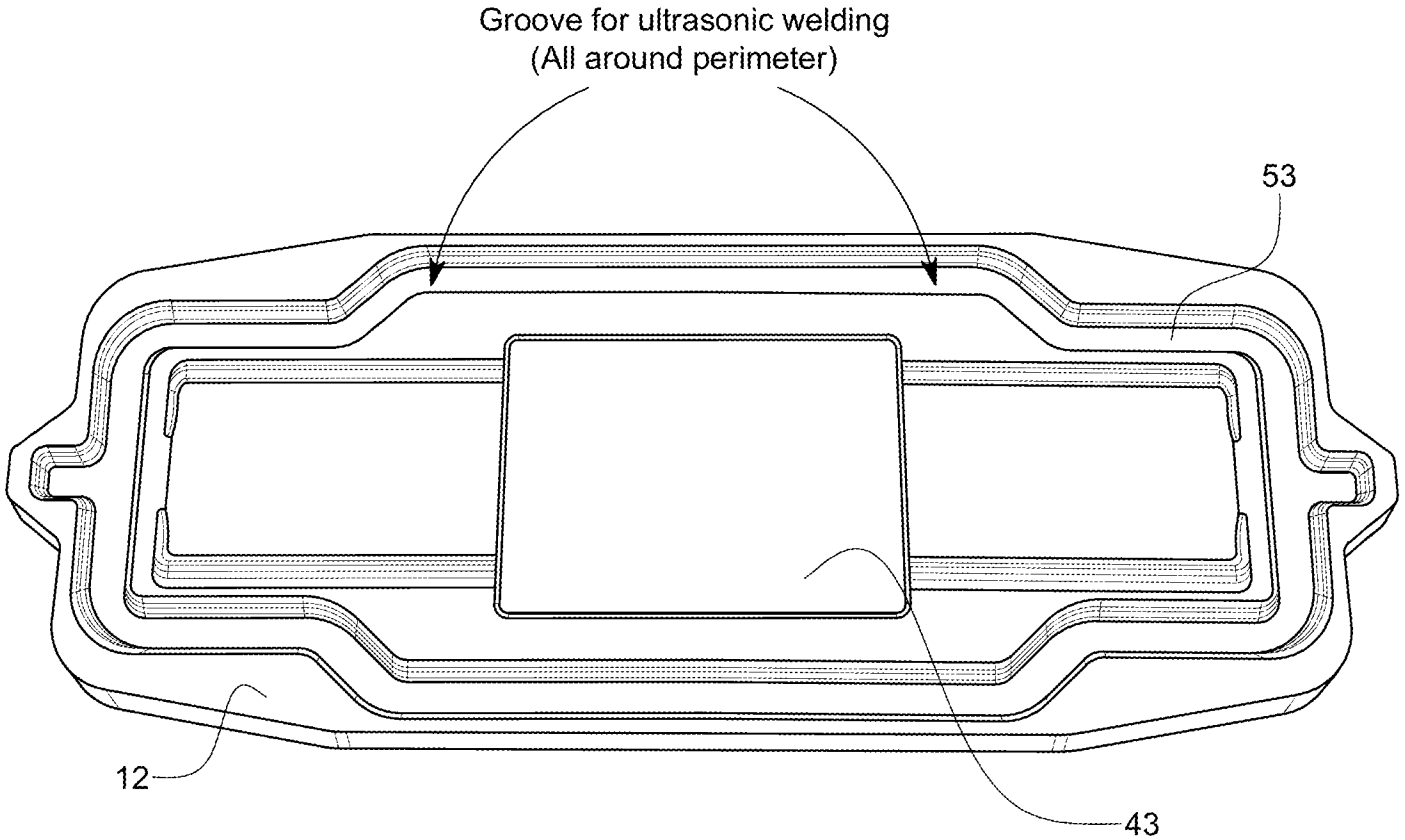
FIG. 5 shows a front, perspective view of the plastic cover of the door check device in accordance with an embodiment of the present patent application.
Figure 6:
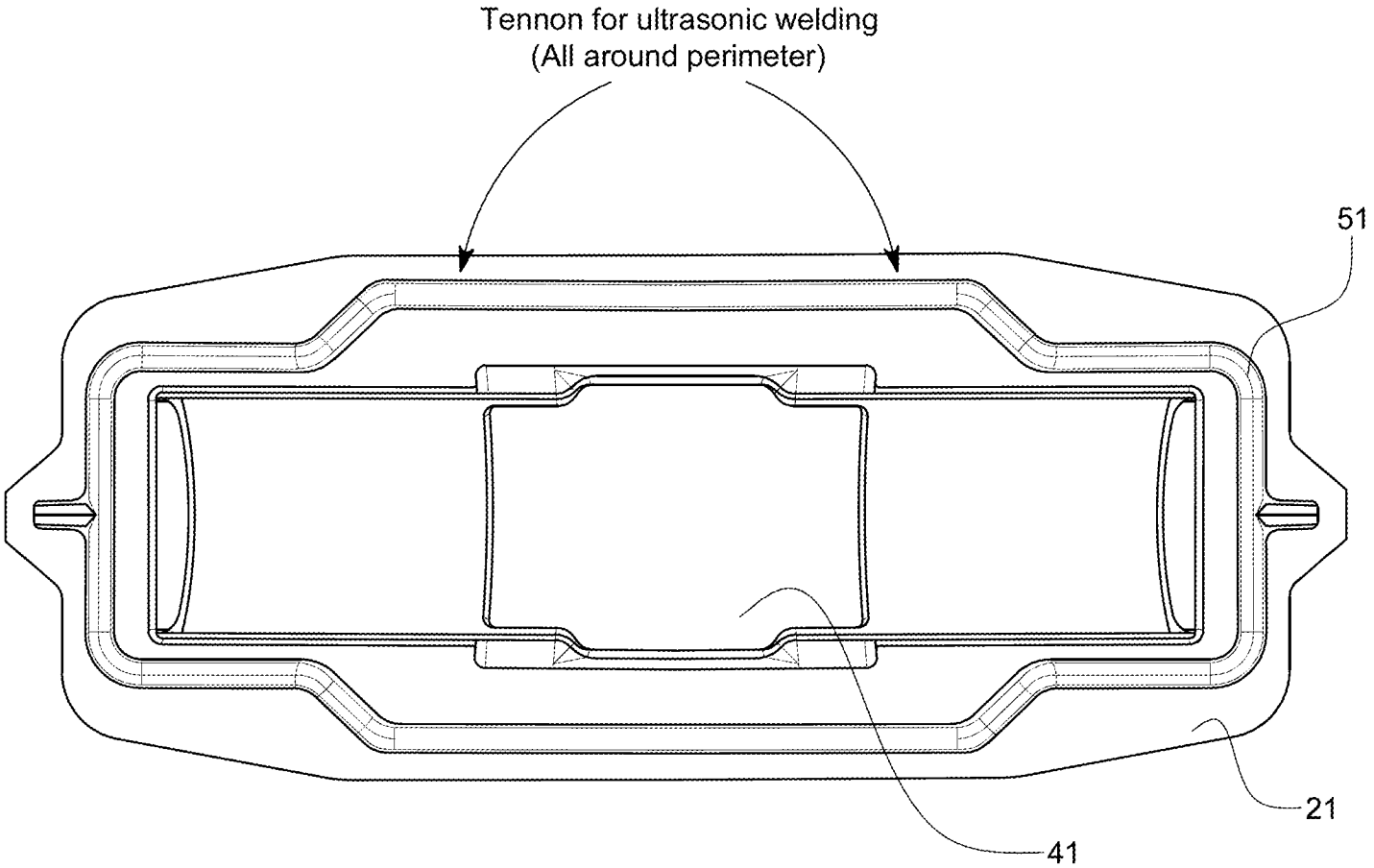
FIG. 6 shows a rear, perspective view of the plastic housing member of the door check device in accordance with an embodiment of the present patent application.
Figure 7:
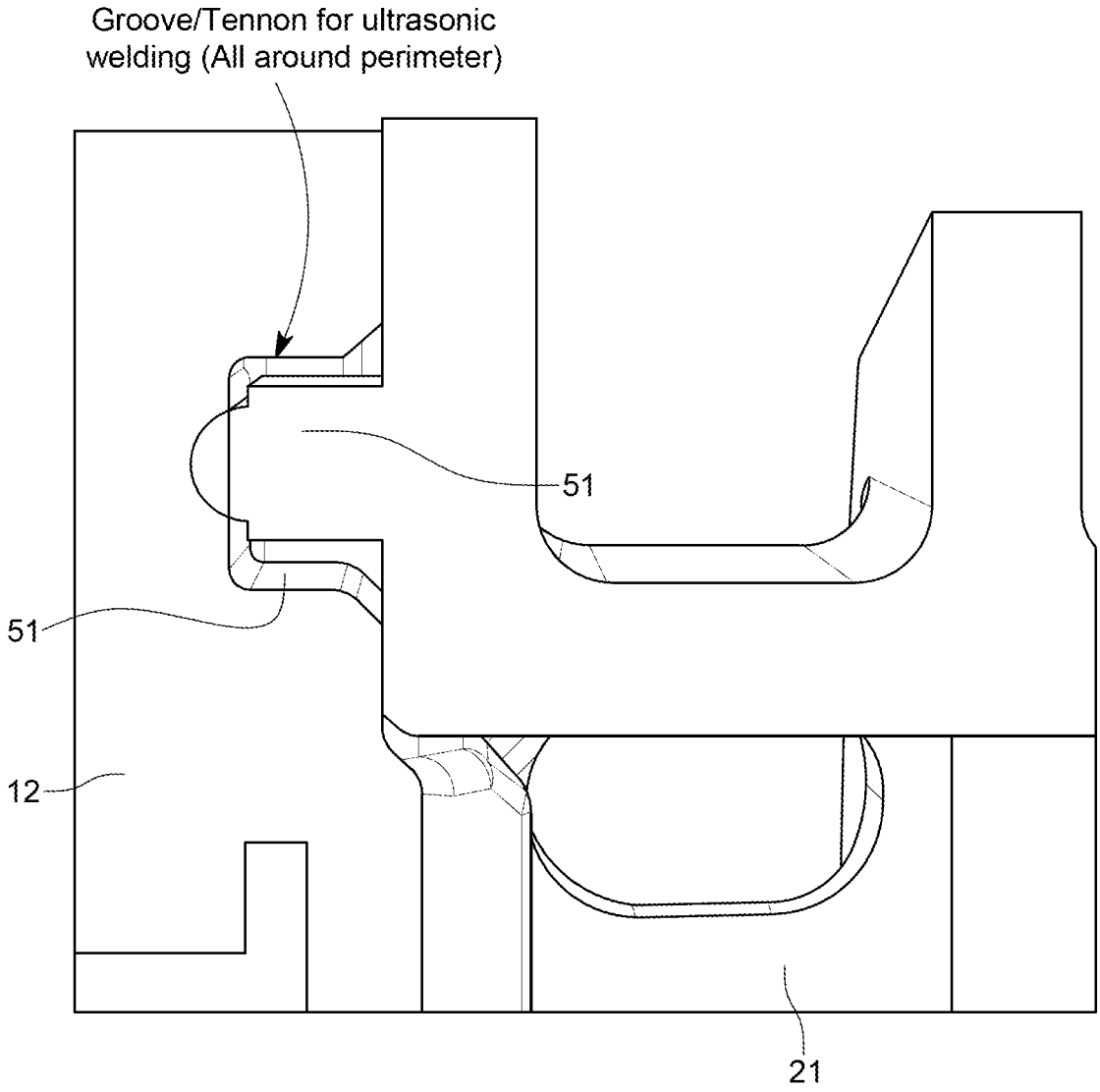
FIG. 7 shows a partial, cross-sectional view of the plastic housing member and the plastic cover of the door check device secured to each other in accordance with an embodiment of the present patent application.
Figure 8:
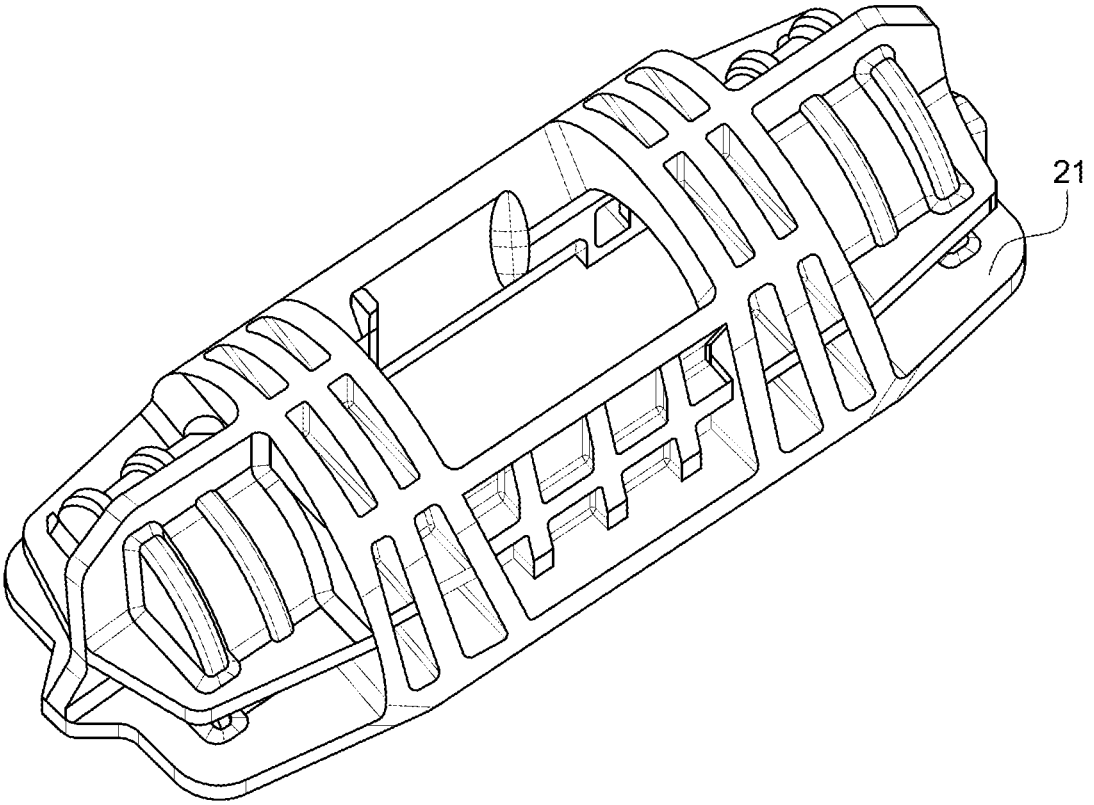
FIG. 8 shows a front, perspective view of the plastic housing member of the door check device in accordance with an embodiment of the present patent application.
Figure 9:
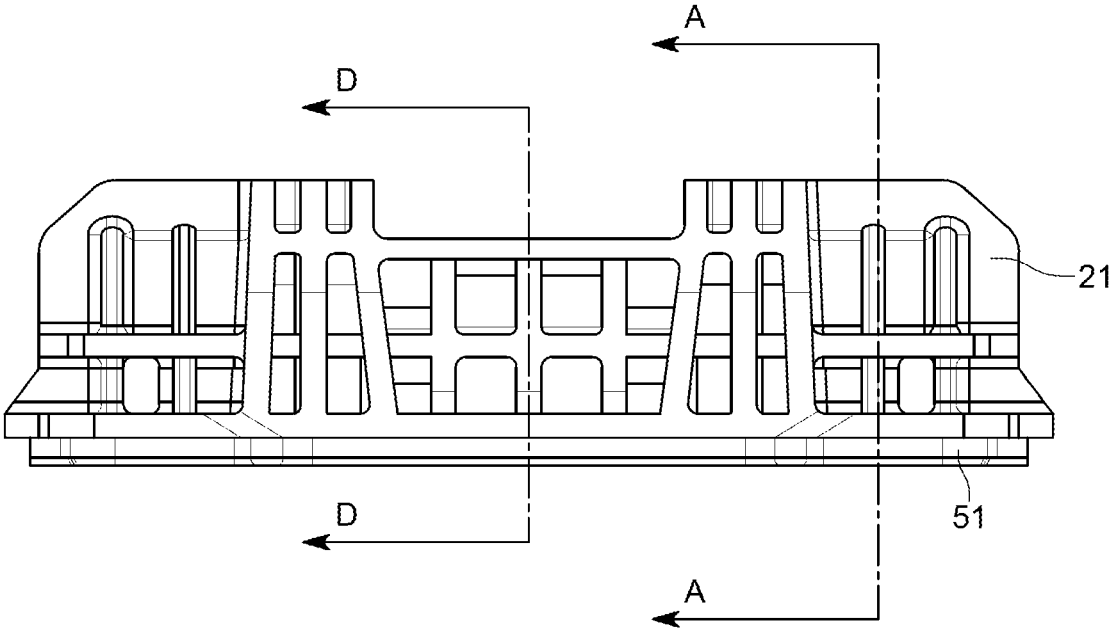
FIG. 9 shows a right side view of the plastic housing member of the door check device in accordance with an embodiment of the present patent application.
Figure 10:
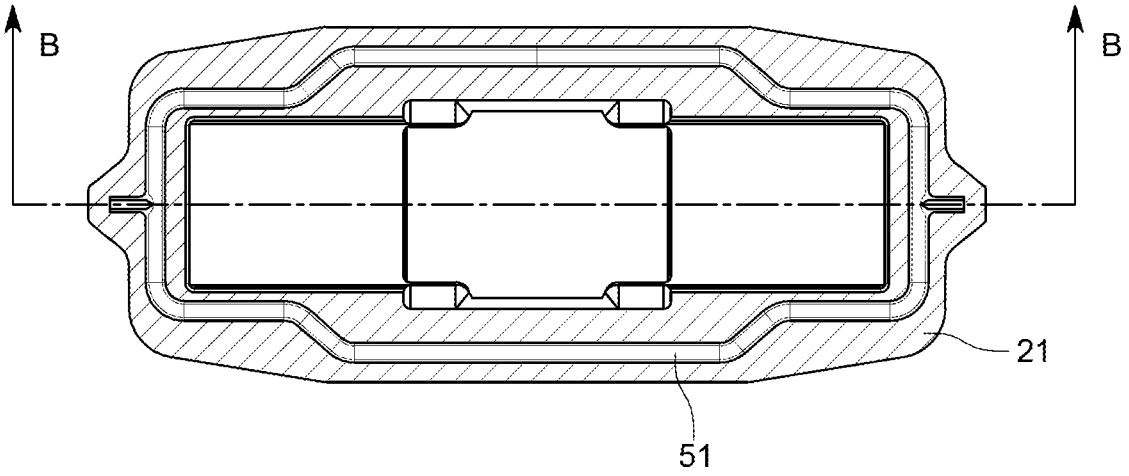
FIG. 10 shows a rear view of the plastic housing member of the door check device in accordance with an embodiment of the present patent application.
Figure 11:
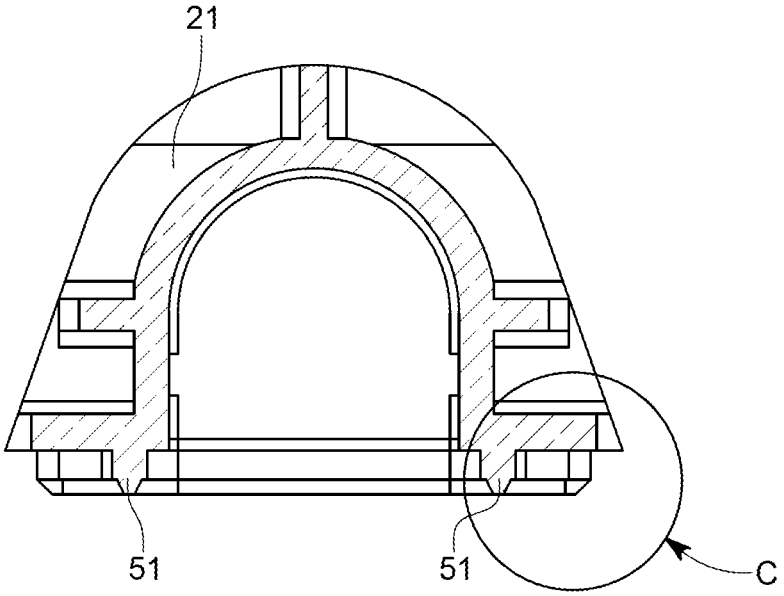
FIG. 11 shows a cross-sectional view of the plastic housing member of the door check device taken along the line A-A of FIG. 9 in accordance with an embodiment of the present patent application.
Figure 12:
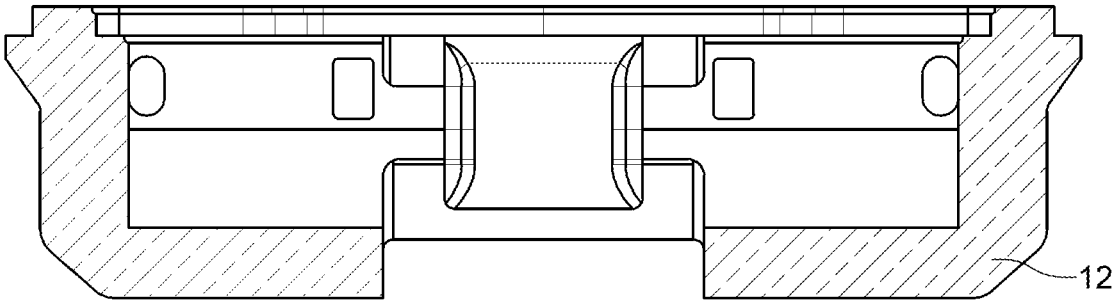
FIG. 12 shows a cross-sectional view of the plastic housing member of the door check device taken along the line B-B of FIG. 10 in accordance with an embodiment of the present patent application.
Figure 13:
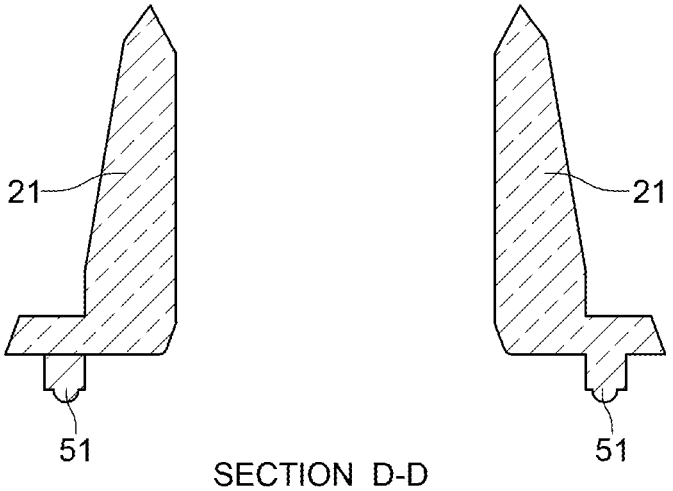
FIG. 13 shows a cross-sectional view of the plastic housing member of the door check device taken along the line D-D of FIG. 9 in accordance with an embodiment of the present patent application.
Figure 14:
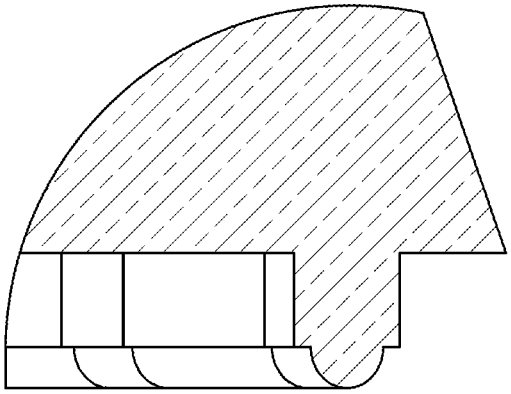
FIG. 14 shows detail C of FIG. 11 of the plastic housing member of the door check device in accordance with an embodiment of the present patent application.
Figure 15:
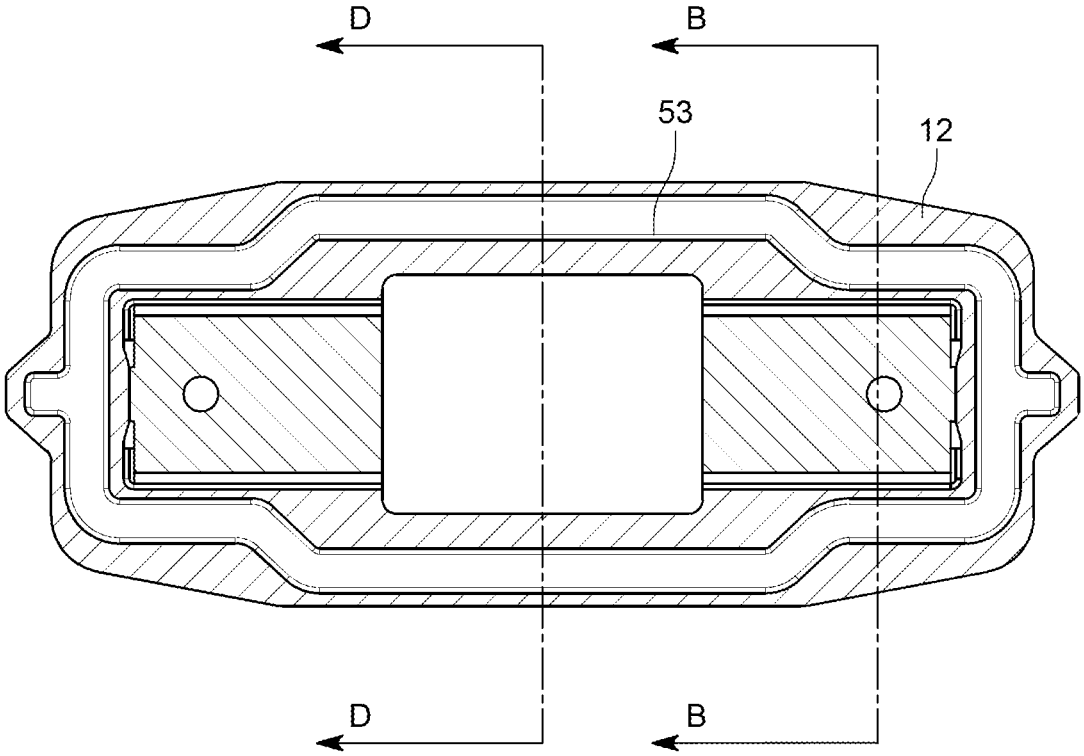
FIG. 15 shows a front view of the plastic cover of the door check device in accordance with an embodiment of the present patent application.
Figure 16:
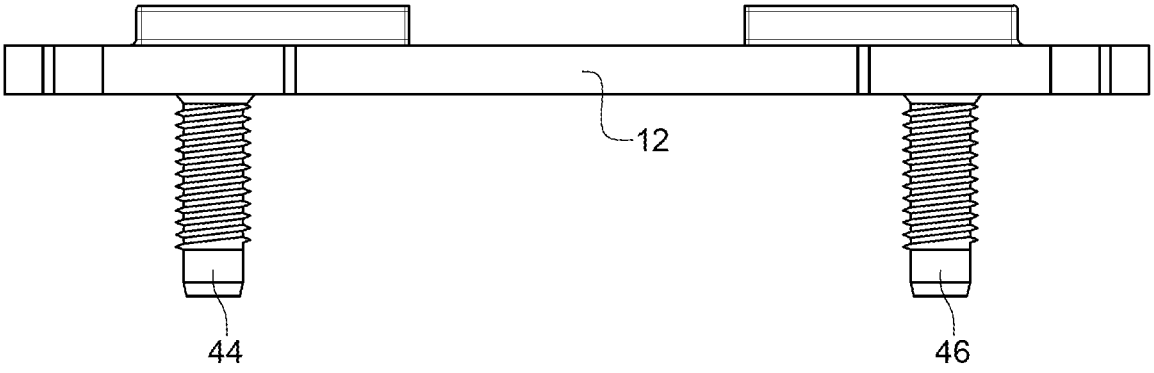
FIG. 16 shows a side, perspective view of the plastic cover of the door check device in accordance with an embodiment of the present patent application.
Figure 17:
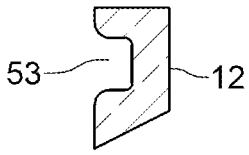
FIG. 17 shows a cross-sectional view of the plastic cover of the door check device taken along the line D-D of FIG. 15 in accordance with an embodiment of the present patent application.
Figure 17:
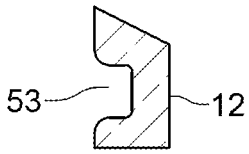
Figure 18:
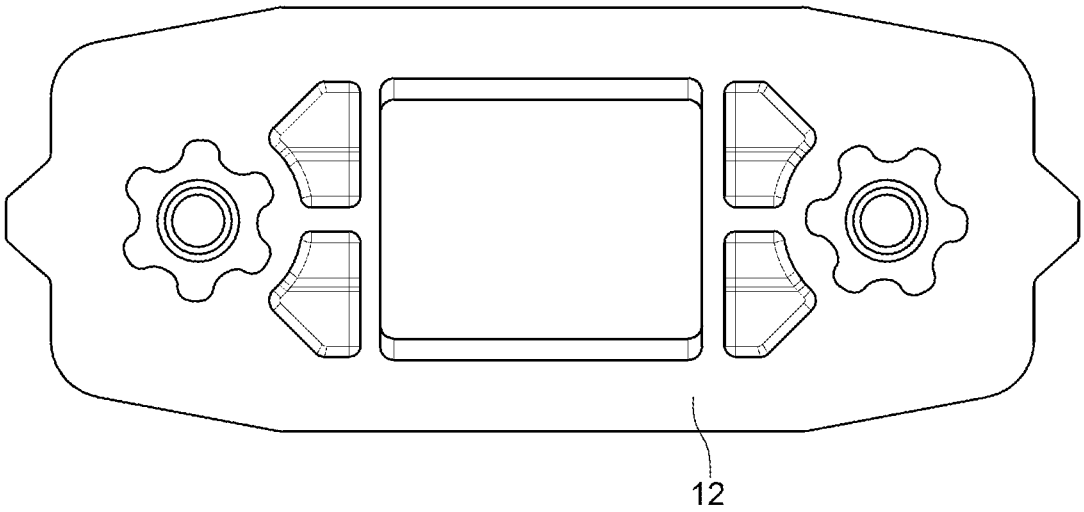
FIG. 18 shows a rear view of the plastic cover of the door check device in accordance with an embodiment of the present patent application.
Figure 19:
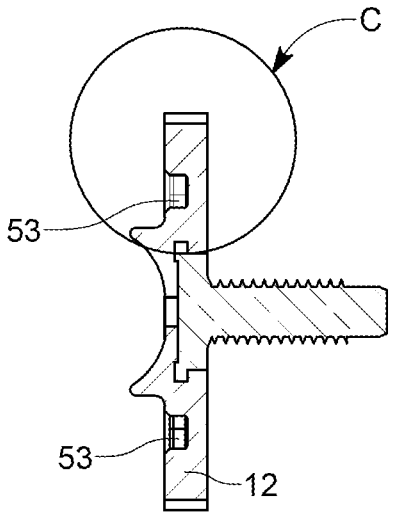
FIG. 19 shows a cross-sectional view of the plastic cover of the door check device taken along the line B-B of FIG. 15 in accordance with an embodiment of the present patent application.
Figure 20:
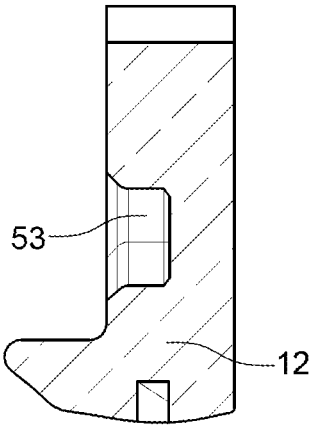
FIG. 20 shows detail C of FIG. 19 of the plastic cover of the door check device in accordance with an embodiment of the present patent application.

Referring to FIGS. 1-20, a door check device 10 for installation between a vehicle body and a vehicle door that swings in opposing opening and closing directions relative to the vehicle body is provided. The construction of the motor vehicle, the vehicle body thereof and the vehicle door thereof are not considered to be part of the present patent application and thus will not be detailed herein. Instead, the present patent application is concerned in detail with the door check device 10.

The door check device 10 comprises a housing assembly 11 and an elongated link member 16. The housing assembly 11 comprises a first mounting structure 12 that is constructed and arranged to be mounted on one of the vehicle body and the vehicle door. In one embodiment, the first mounting structure includes a plastic cover 12. The elongated link member 16 comprises a second mounting structure 14 that is constructed and arranged to be mounted on the other of the vehicle body and the vehicle door.

The mounting structures 12, 14 are referred to as "first" and "second" mounting structures to reflect the fact that the door check device 10 may be installed either by mounting the first mounting structure 12 to the vehicle door and the second mounting structure 14 to the vehicle body or by mounting the first mounting structure 12 to the vehicle body and the second mounting structure 14 to the vehicle door. In the illustrated embodiment, the first mounting structure 12 is constructed and arranged to be mounted within the interior of the vehicle door and the second mounting structure 14 is constructed and arranged to be mounted to the vehicle body.

The housing assembly 11 further comprises biasing structures 13, 15, a first link member engaging structure 18, and the second link member engaging structure 20, and a plastic housing member 21.

The plastic housing member 21 containing the biasing structures 13, 15, the first link member engaging structure 18 and the second link member engaging structure 20 therein. That is, the plastic housing member 21 may be in the form of an open-ended container that includes an interior space 39 for containing the first link member engaging structure 18, the second link member engaging structure 20 and the biasing structures 13, 15.

In one embodiment, the plastic housing member 21 is made from a nylon material, a polypropylene material, or an Acrylonitrile Butadiene Styrene (ABS) material. In one embodiment, the plastic housing member 21 is made from other plastic materials, other polymer materials, other thermoplastic materials, other thermoplastic polymer materials, or other synthetic polymer materials that are configured to be secured to another plastic/polymer member/material by fusion of their materials. In one embodiment, many different types of plastic/polymer material can be used for door check device 10 and can be fused together with non-mechanical fastening methods.

The first link member engaging structure 18 and the second link member engaging structure 20 may be identical to one another. The first link member engaging structure 18 and the second link member engaging structure 20 each may include a roller, a ball or a bearing that is configured to roll/slide over the elongated link member 16. The first link member engaging structure 18 and second link member engaging structure 20 each have a spring bearing portion that contacts the corresponding coil springs 13, 15.

The first link member engaging structure 18 and the second link member engaging structure 20 may in some embodiments move/pivot relative to the housing assembly 11 with the elongated link member 16 such that the first link member engaging structure 18 and the second link member engaging structure 20 remain transverse relation to the elongated link member 16.

The first link member engaging structure 18 and the second link member engaging structure 20 may include complementary contact surfaces 34, 36, respectively that are constructed and arranged to interface with and contact the first and second face surfaces 28, 30 of the elongated link member 16. Thus, as the vehicle door is swung in the opposing opening and closing directions thereof relative to the vehicle body, the elongated link member 16 moves relative to the housing assembly 11 with the complementary contact surface 34 of the first link member engaging structure 18 sliding and travelling along the first face surface 28 of the elongated link member 16 and the complementary contact surface 36 of the second link member engaging structure 20 sliding and travelling along the second face surface 30 of the elongated link member 16. In one embodiment, the complementary contact surface 34 of the first link member engaging structure 18 and the complementary contact surface 36 of the second link member engaging structure 20 may have spherical configurations. In one embodiment, the complementary contact surface 34 of the first link member engaging structure 18 and the complementary contact surface 36 of the second link member engaging structure 20 may have convex configurations.

The biasing structure of the housing assembly 11 includes a pair of biasing elements in the form of coil springs 13, 15 contained within the plastic housing member 21. The plastic housing member 21 may include annular protrusions on opposing interior walls thereof in order to locate corresponding coil springs 13, 15. It is not necessary to use a pair of coil springs 13, 15 as the biasing structure to urge the first link member engaging structure 18 and second link member engaging structure 20 relatively towards one another and into engagement with first and second face surfaces 28, 30 of the elongated link member 16. A single spring (e.g., tension, compression or coil) could be used as the biasing structure to bias one of the first link member engaging structure 18 and the second link member engaging structure 20 relative to the other of the first link member engaging structure 18 and the second link member engaging structure 20, which remains unbiased and may be fixed against movement toward and away from the elongated link member 16. A fixed engaging structure need not be a separate component, and may be integrality formed into the housing, such as by molding. Likewise, a single biasing structure can bias both movable link member engaging structures towards one another. Any suitable biasing arrangement for urging the first link member engaging structure 18 and the second link member engaging structure 20 relatively towards one another can be used.

The elongated link member 16 is configured to extend through the housing assembly 11. The elongated link member 16 has a first opposing end that provides a connecting portion 24 and a second opposing end that provides a stop portion 26. An intermediate portion 22 of the elongated link member 16 extends between the first and second opposing ends and provides the first and second opposing face surfaces 28, 30. In one embodiment, the elongated link member 16 comprises durable low-friction coating (e.g., a mineral-filled nylon coating) thereon.

The connecting portion 24 of the elongated link member 16 may have a bore 25 therethrough and the connecting portion 24 is pivotally connected to the second mounting structure 14. In the illustrated embodiment, the second mounting structure 14 has two arms 27, 29 with pivot pin receiving bores 31, 33 that are used to pivotally connect with the connecting portion 24 via a stepped pivot pin 35. Specifically, the second mounting structure 14 and the connecting portion 24 of the elongated link member 16 are pivotally connected by aligning bores 25, 31, 33 with the connecting portion 24 of the elongated link member 16 between the two arms 27, 29 of the second mounting structure 14 and inserting the pivot pin 35 therethrough. The second mounting structure 14 also may have a bore 37. The second mounting structure 14 is mounted to the vehicle body by use of a bolt inserted through the bore 37. Alternatively, the bore 37 may be omitted and the second mounting structure 14 may be mounted to the vehicle body by welding.

The elongated link member 16 may include a plurality of ramp portions $R_1$, $R_2$, and $R_3$ and a plurality of detents $DU_1$, $DL_1$; $DU_2$, $DL_2$; and $DU_3$, $DL_3$. The ramp portions $R_1$, $R_2$, and $R_3$ are formed adjacent each other and are separated by the detents $DU_1$, $DL_1$; $DU_2$, $DL_2$; and $DU_3$, $DL_3$. More specifically, the ramp portions $R_1$, $R_2$, and $R_3$ each have a larger cross-sectional size than the remainder of the link member's intermediate portion 22 and have upper and lower detents $DU_1$, $DL_1$; $DU_2$, $DL_2$; and $DU_3$, $DL_3$ defined therebetween. In the illustrated embodiment, the first and second face surfaces 28, 30 of the elongated link member 16 are essentially flat, except for the detent regions. In the illustrated embodiment, three ramp portions and three pairs of detents are shown. In another embodiment, the number of the ramp portions and the pairs of detents on the elongated link member 16 may vary. The detents $DU_1$, $DL_1$; $DU_2$, $DL_2$; and $DU_3$, $DL_3$ extend generally in a transverse direction T-T of the elongated link member 16 on the opposing face surfaces 28, 30 thereof. The detents $DU_1$, $DL_1$; $DU_2$, $DL_2$; and $DU_3$, $DL_3$ have a concave configuration.

The stop portion 26 of the elongated link member 16 serves to limit relative movement between the elongated link member 16 and the housing assembly 11, thereby defining a maximum open position for the vehicle door. The stop portion 26 of the elongated link member 16 is configured to prevent the elongated link member 16 from being withdrawn from between the first and second link member engaging structures 18, 20. Also, when the door check device 10 is installed and the vehicle door is swung to its fully open position, the stop portion 26 is configured to prevent the vehicle door from moving beyond the fully open position thereof. Specifically, a portion 49 of the stop portion 26 is configured to engage the plastic housing member 21 to prevent any further movement. The stop portion 26 may in some embodiments be formed from a polymeric material that will cushion the impact and prevent impact noise. Usually, the stop portion 26 is used in conjunction with a stop provided on the vehicle door's hinge.

The elongated link member 16 is received between the first link member engaging structure 18 and the second link member engaging structure 20 that are contained within the housing assembly 11. The first and second face surfaces 28, 30 of the elongated link member 16 interface with and contact the complementary contact surfaces 34, 36 of the first and second link member engaging structures 18, 20, respectively. Thus, as the vehicle door is swung in the opposing opening and closing directions thereof relative to the vehicle body, the elongated link member 16 moves relative to the housing assembly 11 with the first link member engaging structure 18 sliding or travelling along the first face surface 28 of the elongated link member's intermediate portion 22 and the second link member engaging structure 20 sliding or travelling along the second face surface 30 of the elongated link member's intermediate portion 22.

The present patent application is not intended to be limited to complementary relationships per se and may encompass any type of engaged relationship that tends to restrict relative transverse movement between the elongated link member 16 and the first and second link member engaging structures 18, 20. These types of relationships may be broadly referred to as transverse movement restricting relationships. However, a complementary relationship is described here because it provides for a smooth and relatively quiet interaction between the elongated link member 16 and the first and second link member engaging structures 18, 20.

The first and second link member engaging structures 18, 20 are biased to remain in rolling/sliding engagement with respective first and second face surfaces 28, 30 of the elongated link member 16 with the use of the biasing structure that includes the pair of biasing elements in the form of coil springs 13, 15 contained within the housing assembly 11. The coil springs 13, 15 contact the first and second link member engaging structures 18, 20 to affect the biasing of the first and second link member engaging structures 18, 20, respectively. As a result of this engagement, the first and second link member engaging structures 18, 20 move/slide as the elongated link member 16 is moved relative to the housing assembly 11.

The biasing structure with two springs 13, 15 and two retainers/link member engaging structures 18, 20 (i.e., with/without ball/roller) are located between the plastic cover 12 and the plastic housing member 21. The plastic housing member 21 and the plastic cover 12 include aligned openings 41, 43 through which the elongated link member 16 is passed.

The plastic cover 12 of the housing assembly 11 includes aligned and spaced apart generally holes 45, 47 that are bored or stamped therethrough. The housing assembly 11 is mounted within the interior of the vehicle door by use of mounting bolts 44, 46 inserted through these holes 45, 47 in the plastic cover 12. In one embodiment, the mounting bolts 44, 46 may have heads that are configured to cooperate with the holes 45, 47 in the plastic cover 12. For example, in one embodiment, the heads of the mounting bolts 44, 46 may have a star shaped configuration portion 57*a* and a round plate like configuration portion 59*a* over the star shaped configuration portion 57*a*. In one embodiment, the holes 45, 47 in the plastic cover 12 may have complementary shaped configuration portions 57*b*, 59*b* to receive the corresponding star shaped configuration portions 57*a* and the round plate like configuration portions 59*a* on the heads of the mounting bolts 44, 46. That is, in one embodiment, holes 45, 47 are not preform holes to accept the studs 44, 46. In one embodiment, the threaded fasteners/mounting bolts 44, 46 are overmolded during the injection mold process of the cover 12. The net shape of the holes 45, 47 are configured to compliment the shape of the fastener (44, 46) head. In one embodiment, the shape of the fastener head is developed to meet torque out and pull out requirements so as to ensure that they don't come loose or fall out during the assembly process to the vehicle and/or normal use.

In one embodiment, the plastic cover 12 is made from a nylon material, a polypropylene material, or an Acrylonitrile Butadiene Styrene (ABS) material. In one embodiment, the plastic cover 12 is made of other plastic materials, other polymer materials, other thermoplastic materials, other thermoplastic polymer materials, or other synthetic polymer materials that are configured to be secured to another plastic/polymer member/material by fusion of their materials. In one embodiment, many different types of plastic/polymer material can be used for door check device 10 and can be fused together with non-mechanical fastening methods.

The plastic door check device 10 uses non-mechanical fastening methods to secure the two halves (i.e., plastic housing member 21 and plastic cover 12) of the housing assembly 11 of the door check device 10 together.

The plastic housing member 21 has a first engagement structure 51. The plastic cover 12 has a second engagement structure 53 that is constructed and arranged to engage with the first engagement structure 51 to form an area of contact therebetween. The plastic housing member 21 and the plastic cover 12 are secured by fusion of the materials to each other in the area of contact between the first and the second engagement structures 51 and 53.

In one embodiment, one of the first engagement structure 51 of the plastic housing member 21 and the second engagement structure 53 of the plastic cover 12 include a groove and the other of the first engagement structure 51 of the plastic housing member 21 and the second engagement structure 53 of the plastic cover 12 include a tenon/tongue. In one embodiment, the tenon is constructed and shaped to follow the profile of the groove. That is, an outside surface of the tenon is configured to match with an inside surface of the groove. In one embodiment, the tenon includes a tongue, a tab, a ridge, or a protrusion that is configured to match the profile of the groove and is configured to form-fit within the groove.

The first engagement structure 51 on the plastic housing member 21 and the second engagement structure 53 on the plastic cover 12 are each formed on the corresponding mating surfaces of the plastic housing member 21 and the plastic cover 12, respectively.

In one embodiment, the first engagement structure 51 of the plastic housing member 21 and the second engagement structure 53 of the plastic cover 12 are each configured to extend around the entire periphery of the plastic housing member 21 and the plastic cover 12, respectively. In another embodiment, the first engagement structure 51 of the plastic housing member 21 and the second engagement structure 53 of the plastic cover 12 are each configured to extend only around portions of the periphery of the plastic housing member 21 and the plastic cover 12, respectively.

The first engagement structure 51 of the plastic housing member 21 and the second engagement structure 53 of the plastic cover 12 are configured to interact with each other to properly locate the plastic housing member 21 and plastic cover 12 onto/with one another. The first engagement structure 51 of the plastic housing member 21 and the second engagement structure 53 of the plastic cover 12 are not only used as locating features to locate the plastic housing member 21 and plastic cover 12 during the assembly process but also used as main attachment features between the plastic housing member 21 and plastic cover 12 to fuse the plastic housing member 21 and plastic cover 12 together during the ultrasonic welding process.

During the assembly process, the first engagement structure 51 of the plastic housing member 21 and the second engagement structure 53 of the plastic cover 12 are configured to sacrificially deform when exposed to vibrations from an ultrasonic welder. The ultrasonic welder is configured to fuse the two parts (i.e., the plastic cover 12 and the plastic housing member 21) together and contain the internal components (i.e., springs 13, 15 and sliders 18, 20). The bonding of the two components (i.e., the plastic cover 12 and the plastic housing member 21) is sufficiently strong to withstand the forces imposed by the door check arm/elongated link member 16 when sliding in/out of the door check device 10, as well as the forces from the internal springs 13, 15.

In one embodiment, the plastic cover 12 is assembled onto the plastic housing member 21 in a direction perpendicular to spring force direction. For example, the spring force direction may either be downwardly from the spring 13 to the door check arm/elongated link member 16 or be upwardly from the spring 15 to the door check arm/elongated link member 16. In one embodiment, the plastic cover 12 is assembled onto the plastic housing member 21, from one side thereof, and in the direction perpendicular to the spring force direction. Therefore, the internal springs 13, 15 do not interfere with the fusion.

In one embodiment, ultrasonic welding of the plastic cover 12 and the plastic housing member 21 is performed by providing high frequency vibrations from the ultrasonic welder. The ultrasonic welder is configured to contact a surface of the plastic cover 12 or the plastic housing member 21. The vibrations from the ultrasonic welder may cause intermolecular friction between the plastic cover 12 and the plastic housing member 21. This increases a temperature at portions where the plastic cover 12 and the plastic housing member 21 contact. The increase in temperature melts the plastic material causing a flow of plastic material between the plastic cover 12 and the plastic housing member 21. After the vibrations from the ultrasonic welder are stopped, the plastic material solidifies and a weld results between the plastic cover 12 and the plastic housing member 21.

In another embodiment, alternative non-mechanical fastening methods may be used to secure the two halves (i.e., the plastic cover 12 and the plastic housing member 21) of the door check device 10 together. For example, such alternative non-mechanical fastening methods may include laser welding, or any other process that fuses two door check components together without the use of mechanical fasteners that are staked, spun or screwed together.

When the door check device 10 is installed and the vehicle door is swung in the opposing opening and closing directions thereof relative to the vehicle body, the elongated link member 16 and the housing assembly 11 are configured to move relative to each other with the first and the second link member engaging structures 18 and 20 travelling along the opposing face surfaces 28, 30 of the elongated link member 16.

When the door check device 10 is installed and the vehicle door is swung in the opposing opening and closing directions thereof relative to the vehicle body, the biasing structures 13, 15 is configured to bias the first and the second link member engaging structures 18 and 20 relatively towards one another to thereby urge the first and the second link member engaging structures 18 and 20 into engagement with the opposing face surfaces 28, 30 of the elongated link member 16.

When the door check device 10 is installed and the vehicle door is swung to a location with respect to the vehicle body, the first and the second link member engaging structures 18 and 20 cooperate with the detents $DU_1$, $DL_1$; $DU_2$, $DL_2$; or $DU_3$, $DL_3$ on the opposing face surfaces 28, 30 of the elongated link member 16 so as to maintain the vehicle door at that position until a force is applied to the vehicle door that is sufficient to cause the elongated link member 16 and the housing assembly 11 to move relative to each other so as to urge the first and the second link member engaging structures 18 and 20 relatively apart from one another and out of cooperation the detents $DU_1$, $DL_1$; $DU_2$, $DL_2$; or $DU_3$, $DL_3$ on the opposing face surfaces 28, 30 of the elongated link member 16 against the biasing of the biasing structures 13, 15.

As the elongated link member 16 is moved in the longitudinal direction thereof due to vehicle door opening and closing movements, the first and second link member engaging structures 18, 20 move/slide along the face surfaces 28, 30 of the elongated link member 16 and may be configured to accommodate any relative yaw movement of the elongated link member 16.

Specifically, because of the structure and configuration of the first and second link member engaging structures 18, 20, the first and second link member engaging structures 18, 20 are able to move relative to and within the housing assembly 11 in the illustrated non-limiting embodiment. This permits the first and second link member engaging structures 18, 20 to be maintained in proper alignment with respective face surfaces 28, 30 of the elongated link member 16 as the elongated link member 16 causes the relative yaw position of the housing assembly 11 to change with respect to the elongated link member 16 that is passing through the housing assembly 11. Thus, the first and second link member engaging structures 18, 20 pivot together relative to the housing assembly 11 to remain perpendicular to the elongated link member 16 as it shifts in a yaw-type manner.

The friction between the first and second link member engaging structures 18, 20 and the elongated link member 16 due to the load from the coil springs 13, 15 is sufficient to cause the first and second link member engaging structures 18, 20 to move/slide together with the elongated link member 16 as it undergoes yaw movement. Specifically, the frictional characteristics (i.e., coefficient of friction) of the elongated link member 16 and the first and the second link member engaging structures 18, 20 is selected in such a way that they will effectively remain engaged in perpendicular relation as the elongated link member 16 undergoes yaw movement.

The term "yaw" in the context of the present patent application is used to describe the movement that the elongated link member 16 may undergo relative to the housing assembly 11 generally along a yaw plane that is defined as extending along both the transverse direction and the longitudinal extent of the elongated link member 16. This yaw movement of the elongated link member 16 can occur as a result of the path along which the vehicle door swings. Also, this movement can occur as a result of free play being permitted between the connection of the first mounting structure 12 and the second mounting structure 14 of the elongated link member 16 to the vehicle body and the vehicle door.

By allowing the first and the second link member engaging structures 18, 20 to move along with the elongated link member 16 in its yaw movement, the first and the second link member engaging structures 18, 20 can remain in their respective movement restricting relationships with the face surfaces 28, 30. Additionally, the upper and lower detents will not become misaligned with respect to the first and the second link member engaging structures 18, 20.

Continued movement of the elongated link member 16 relative to the first mounting structure 12 causes the first and the second link member engaging structures 18, 20 to contact the first ramp portion $R_1$ and then roll up the first ramp portion $R_1$. As the first and the second link member engaging structures 18, 20 roll up/slide past the first ramp portion $R_1$, the movement of the first and the second link member engaging structures 18, 20 in a direction away from the elongated link member 16 deflects the coil springs 13, 15. As the deflection of the coil springs 13, 15 increases, the resistance they provide to door movement likewise increases. As the first and the second link member engaging structures 18, 20 pass over the apexes of the first ramp portion $R_1$, the increased biasing force in coil springs 13, 15 biases the first and the second link member engaging structures 18, 20 into engagement with the elongated link member 16 in a cooperating relation with the upper and lower detents $DU_1$, $DL_1$. This is the first checked position.

The first and the second link member engaging structures 18, 20 are constructed and arranged such that when the vehicle door is swung to the checked position with respect to the vehicle body with the first and the second link member engaging structures 18, 20 received within the upper and lower detents $DU_1$, $DL_1$; $DU_2$, $DL_2$; or $DU_3$, $DL_3$, the first and the second link member engaging structures 18, 20 and the detents $DU_1$, $DL_1$; $DU_2$, $DL_2$; or $DU_3$, $DL_3$ cooperate to maintain the vehicle door at this checked position until a force is applied to the motor vehicle door sufficient to cause the elongated link member 16 to move relative to the first and the second link member engaging structures 18, 20 so as to urge the first and the second link member engaging structures 18, 20 generally apart from one another against the biasing of the coil springs 13, 15, thus moving the first and the second link member engaging structures 18, 20 out of their respective detents $DU_1$, $DL_1$; $DU_2$, $DL_2$; or $DU_3$, $DL_3$. Specifically, the door check device 10 functions to maintain the checked position until the force applied to the vehicle door is sufficient to move the elongated link member 16 relative to the first and the second link member engaging structures 18, 20 so as to cause the first and the second link member engaging structures 18, 20 to ride up one of the plurality of ramp portions $R_1$, $R_2$, and $R_3$ and over the apexes thereof against the resistance of the coil springs 13, 15. The force required to cause the first and the second link member engaging structures 18, 20 to ride up one of the plurality of ramp portions $R_1$, $R_2$, and $R_3$ is determined by the spring constant and the heights and geometries of the plurality of ramp portions $R_1$, $R_2$, and $R_3$.

As noted in the discussions above, the elongated link member 16 may include more than one pair of upper and lower detents $DU_1$, $DL_1$; $DU_2$, $DL_2$; and $DU_3$, $DL_3$ to provide more than one checked position.

In one embodiment, there is a weight advantage to eliminate the steel fasteners from the plastic door check device 10. In addition, the processing time for an ultrasonic weld is reduced compared to prior art methods that used to secure steel pins/rivets/screws. This can be a cost advantage to produce the door check device 10.

Although the present patent application has been described in detail for the purpose of illustration, it is to be understood that such detail is solely for that purpose and that the present patent application is not limited to the disclosed embodiments, but, on the contrary, is intended to cover modifications and equivalent arrangements that are within the spirit and scope of the appended claims. In addition, it is to be understood that the present patent application contemplates that, to the extent possible, one or more features of any embodiment can be combined with one or more features of any other embodiment.

The illustration of the embodiments of the present patent application should not be taken as restrictive in any way since a myriad of configurations and methods utilizing the present patent application can be realized from what has been disclosed or revealed in the present patent application. The systems, features and embodiments described in the present patent application should not be considered as limiting in any way. The illustrations are representative of possible construction and mechanical embodiments and methods to obtain the desired features. The location and/or the form of any minor design detail or the material specified in the present patent application can be changed and doing so will not be considered new material since the present patent application covers those executions in the broadest form.

The foregoing illustrated embodiments have been provided to illustrate the structural and functional principles of the present patent application and are not intended to be limiting. To the contrary, the present patent application is intended to encompass all modifications, alterations and substitutions within the spirit and scope of the appended claims.

What is claimed is:

1. A door check device for installation between a vehicle body and a vehicle door that swings in opposing opening and closing directions relative to the vehicle body, the door check device comprising:

a housing assembly, the housing assembly comprises:

a first mounting structure constructed and arranged to be mounted on one of the vehicle body and the vehicle door;

a biasing structure;

a first link member engaging structure and a second link member engaging structure; and a plastic housing member containing the biasing structure, the first link member engaging structure and the second link member engaging structure therein, the plastic housing member having a first engagement structure;

the first mounting structure including a plastic cover, the plastic cover having a second engagement structure that is constructed and arranged to engage with the first engagement structure to form an area of contact therebetween, wherein the plastic housing member and the plastic cover are secured by fusion of the materials to each other in the area of contact between the first and the second engagement structures;

an elongated link member, the elongated link member extending through the housing assembly, the elongated link member comprises:

a second mounting structure constructed and arranged to be mounted on the other of the vehicle body and the vehicle door; and detents that extend generally in a transverse direction of the elongated link member on opposing face surfaces thereof;

wherein, when the door check device is installed and the vehicle door is swung in the opposing opening and closing directions thereof relative to the vehicle body, the elongated link member and the housing assembly are configured to move relative to each other with the first and the second link member engaging structures travelling along the opposing face surfaces of the elongated link member; and wherein, when the door check device is installed and the vehicle door is swung in the opposing opening and closing directions thereof relative to the vehicle body, the biasing structure is configured to bias the first and the second link member engaging structures relatively towards one another to thereby urge the first and the second link member engaging structures into engagement with the opposing face surfaces of the elongated link member; and wherein, when the door check device is installed and the vehicle door is swung to a location with respect to the vehicle body, the first and the second link member engaging structures cooperate with the detents on the opposing face surfaces of the elongated link member so as to maintain the vehicle door at that position until a force is applied to the vehicle door that is sufficient to cause the elongated link member and the housing assembly to move relative to each other so as to urge the first and the second link member engaging structures relatively apart from one another and out of cooperation with the detents on the opposing face surfaces of the elongated link member against the biasing of the biasing structure.

2. The door check device of claim 1, wherein the first engagement structure of the plastic housing member and the second engagement structure of the plastic cover are configured to align the plastic cover and the plastic housing member.

3. The door check device of claim 1, wherein one of the first engagement structure of the plastic housing member and the second engagement structure of the plastic cover includes a groove and the other of the first engagement structure of the plastic housing member and the second engagement structure of the plastic cover includes a tenon.

4. The door check device of claim 1, wherein the first engagement structure of the plastic housing member and the second engagement structure of the plastic cover are each configured to extend around the entire periphery of the plastic housing member and the plastic cover, respectively.

* * * * *